United States Patent [19]

Tackitt

[11] 4,223,461

[45] Sep. 23, 1980

[54] SLOPEBOARD MOUNTING

[76] Inventor: Coy C. Tackitt, Crestline, Calif. 92325

[21] Appl. No.: 947,727

[22] Filed: Oct. 2, 1978

[51] Int. Cl.[3] ..... E02F 3/76

[52] U.S. Cl. ..... 37/105; 172/802

[58] Field of Search ..... 37/105–107; 172/802, 804, 782

[56] References Cited

U.S. PATENT DOCUMENTS

| | | | |
|---|---|---|---|
| 2,646,633 | 7/1953 | Jahn | 172/802 |
| 2,948,973 | 8/1960 | Magouirk et al. | 172/802 |
| 3,061,955 | 11/1962 | Violette | 172/802 |
| 3,348,322 | 10/1967 | Stewart | 172/782 X |
| 3,429,380 | 2/1969 | Launder et al. | 172/802 |
| 3,429,381 | 2/1969 | Launder et al. | 172/802 |
| 3,464,499 | 9/1969 | McKell | 172/802 |
| 3,807,064 | 4/1974 | Schmidt, Jr. | 37/105 X |
| 4,019,268 | 4/1977 | Waterman | 172/802 X |
| 4,068,726 | 1/1978 | Heitman | 172/802 |
| 4,079,791 | 3/1978 | Yoder et al. | 172/802 |

FOREIGN PATENT DOCUMENTS

| | | | |
|---|---|---|---|
| 1525951 | 1/1967 | France | 172/802 |

*Primary Examiner*—E. H. Eickholt

*Attorney, Agent, or Firm*—Fulwider, Patton, Rieber, Lee & Utecht

[57] ABSTRACT

A mounting for a slopeboard used to grade soil on an incline is provided near the edge on the backside of a bulldozer blade on an earth moving vehicle. The mounting includes a reinforcing gusset which receives both a connection from a transverse mounting beam secured to the front of a vehicle frame and also a rearwardly and outwardly extending slopeboard support. The slopeboard is mounted about an axis extending from another gusset at the edge of the bulldozer blade rearwardly to an extremity of the slopeboard support. An actuating hinge is connected atop the slopeboard support to accommodate a pressurized fluid actuating cylinder. The slopeboard can be rotated from a vertical orientation to an outwardly extended position below grade, always behind th edge of the bulldozer blade.

9 Claims, 5 Drawing Figures

SLOPEBOARD MOUNTING

BACKGROUND OF THE INVENTION

1. Field of the Invention

The present invention relates to slopeboard mountings for use with bulldozers and other earth moving vehicles.

2. Description of the Prior Art

Bulldozers have for years been used in landscape grading in connection with residential and commercial construction. In recent years an auxiliary blade, known as a slopeboard or mold board has gained in increasing usuage as an auxiliary earth contouring device. The slopeboard, as conventionally attached to an earthmoving vehicle, is mounted for extension to one side of a main bulldozer blade. The slopeboard is hydraulically or pneumatically actuated and may be raised to extend from the base of a lower corner of the bulldozer blade upward at an angle, or lowered to slant downward from the bulldozer blade corner, extending below the level thereof. This later application is only possible where the terrain slopes downward from the level of the bulldozer.

Although slopeboards have been widely utilized, their attachment to a bulldozer blade, or to the vehicle itself, has heretofore been accompanied by numerous problems. Usually the slopeboard blade is attached directly to an unreinforced portion of the main bulldozer blade. The resulting structure is somewhat unwieldy and definitely lacks structural integrity. That is, because the slopeboard is in effect hung from and supported by the bulldozer blade, considerable flexure of the slopeboard blade results when the earthmoving vehicle is in motion and the slopeboard blade is used to contour the landscape. As a result, the soil appearance of ground terraced by the slopeboard is irregular due to the halting, jerking movement of the slopeboard thereacross. In addition, the slopeboard mounting frequently becomes bent and deformed, and quite often fractures, thereby requiring repairs and disabling the vehicle while such repairs are performed. As a consequence, in conventional usage a slopeboard is utilized only for very light terracing.

A further problem found with conventional slopeboard mounting arrangements is the inflexibility of blade disposition. Typically, a blade can be raised only to a relatively small acute angle, such as 45° or 50° with respect to level terrain. Even when the slopeboard blade is not in use the earth moving vehicle, cannot pass close to trees and structures on the slopeboard side. This seriously limits the movement of the vehicle and adds extensively to the time required to landscape an area, since the bulldozer operator must constantly reposition the earth moving vehicle so that the slopeboard does not interfere with landscaping efforts using the main bulldozer blade near objects or structures in the vicinity.

A further problem with conventional slopeboard mounting systems is the failure to properly provide a smooth, even flow of dirt from the main bulldozer blade onto the slopeboard blade. In many conventional systems, the mounting arrangement includes attaching structure positioned on the front side of the main bulldozer blade. This seriously disrupts the flow of dirt off of the main blade and into the path of the slopeboard blade. As a result, longitudinally extending ridges are formed behind the bulldozer as it moves forward. In other systems, in which the slopeboard is mounted behind the main bulldozer blade, the separation is mounted behind the main bulldozer blade, the separation therebetween is so large that the slopeboard blade and the bulldozer blade plow at different levels in an area of overlap. As a consequence, furrows and ridges are frequently formed in the trial of the path movement of the earth moving vehicle.

SUMMARY OF THE INVENTION

The present invention resides in a mounting arrangement by means of which a slopeboard is rigidly positioned relatively to an earth moving vehicle frame and also relative to the main bulldozer blade of the vehicle. This structural integrity is achieved by utilizing a reinforcing gusset plate fastened to the backside of the bulldozer blade proximate to a connection to the vehicle frame. A horizontally disposed, rearwardly and outwardly extending slopeboard support is also provided and is rigidly secured to the reinforcing gusset plate. The slopeboard support includes a horizontal mounting connection by means of which the slopeboard rotates in a vertical plane, perpendicular to the direction of vehicle travel, and a laterally separated actuating hinge, interiorally located from the mounting connection, to receive a pressurized fluid actuating cylinder. The cylinder is connected at a remote end to a cantilevered portion of the slopeboard, and is utilized to raise the slopeboard to a vertical orientation when desired. Alternatively, the slopeboard can be lowered to a position extending below grade, as with conventional slope board mounting arrangements.

Preferably, the mounting connection extends horizontally forward from the rearward end of the slopeboard support and is rigidly secured to another gusset plate on the backside of the main bulldozer blade. The resulting structure forms a rigid triangle of supporting members. This mounting arrangement significantly reduces the tendency of the slopeboard mounting to flex rearward during forward movement of the earth moving vehicle, and significantly improves the structural integrity of the mounting arrangement.

The invention may be explained with greater clarity and particularly by reference to the accompanying drawings.

DESCRIPTION OF AN EMBODIMENT

Figure 1:
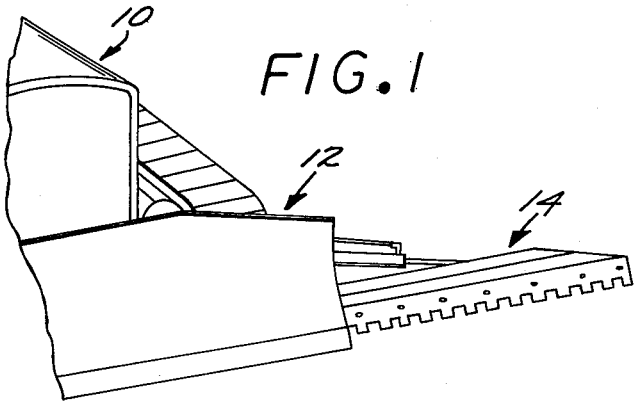
FIG. 1 is a perspective view of a portion of the front of an earth moving vehicle employing a slopeboard blade.
Figure 2:
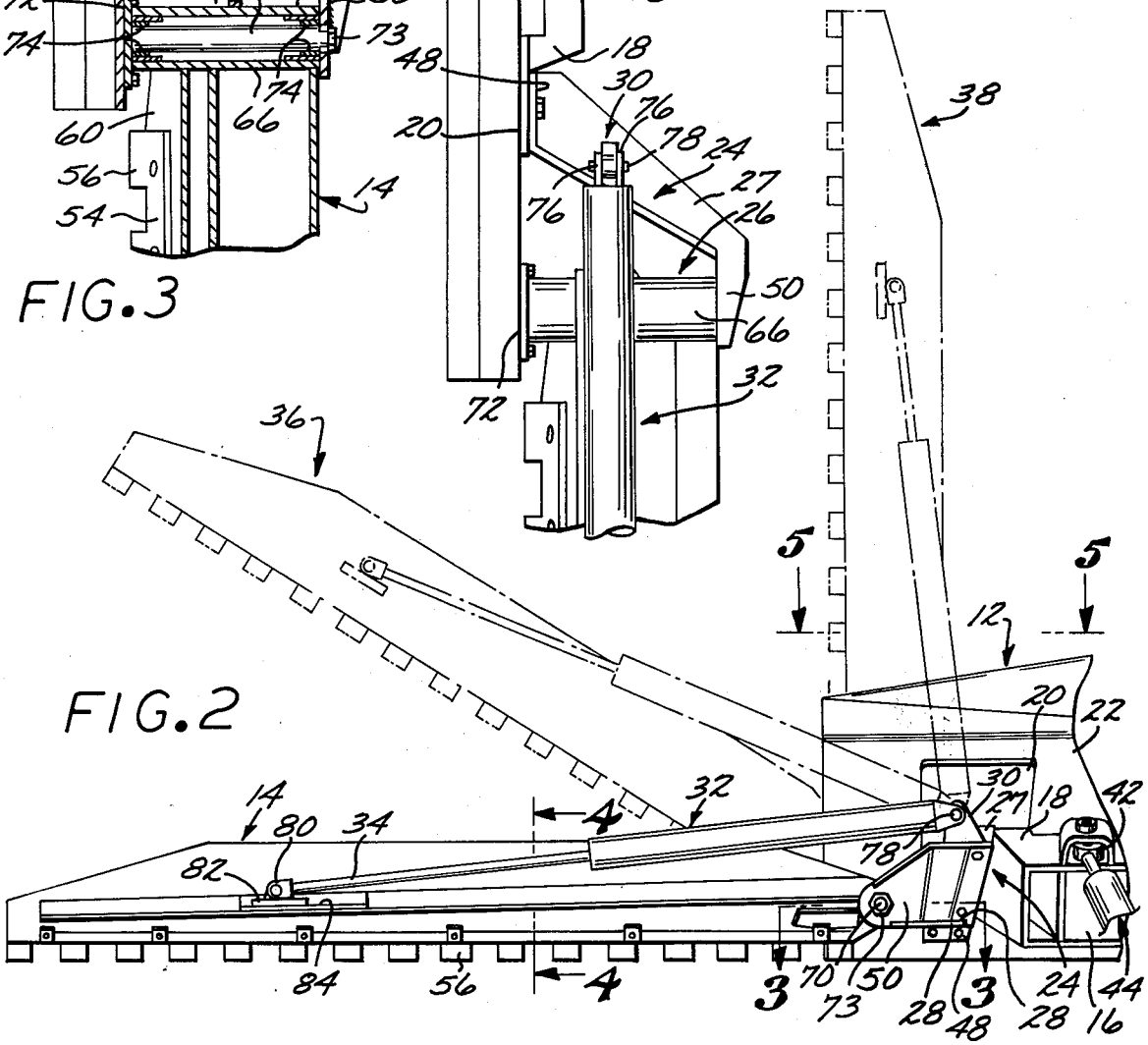
FIG. 2 is a prespective view from the rear showing the slopeboard mounting on the vehicle of FIG. 1.

FIG. 1 illustrates a conventional tracked vehicle 10 operated by an internal combustion engine and having a slightly concave generally rectangular bulldozer blade 12 mounted in upright fashion forward of the structure of the vehicle 10. To one side of the bulldozer blade 12 there is an outwardly extending smaller and narrower, slightly concave slopeboard or moldboard 14. As illustrated in FIG. 2, the main bulldozer blade 12 is carried from a transversely extending mounting beam 16, which may be a steel I-beam, and which extends across the front of the vehicle. Forwardly turned mounting brackets 18 are welded to both ends of the mounting beam 16 and to a vertically disposed gusset plate 20 on one side of the blade 12. The gusset plate 20 in turn is welded to the backside 22 of the main bulldozer blade 12. From the gusset plate 20 a channel shaped slopeboard support 24 about five feet long, with inwardly turned legs 27 and 28 extends rearwardly and outwardly in horizontal disposition, as depicted in FIGS. 2 and 5.

The slopeboard support 24 carries a hinge like mounting connection 26 that includes a pin and sleeve coupling and about which the slopeboard 14 rotates in a vertical plane. The slopeboard support 24 also has an upright bracket 30 extending from the uppermost leg 27 of the slopeboard support channel 24. The bracket 30 forms a hinge connection for a hydraulic or pneumatic pressurized fluid actuating cylinder 32. The piston rod 34 extending out of the cylinder 32 is connected to a remote location on the slopeboard 14. The slopeboard 14 can thereby be laterally extended, as depicted in solid lines in FIG. 2, or it can be raised to an intermediate position depicted at 36, or even to a vertical upright position indicated at 38 in FIG. 2.

Figure 5:
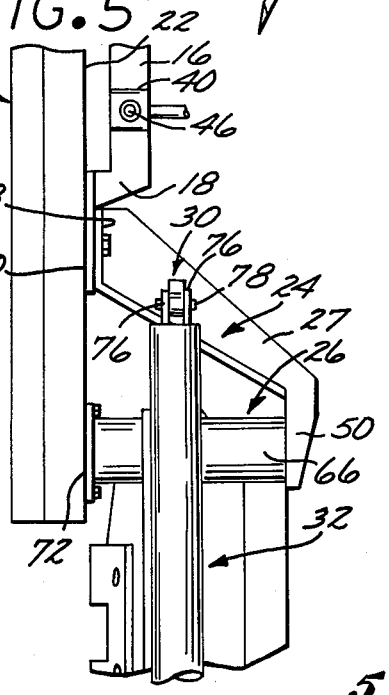
FIG. 5 is a plan view taken along the lines 5—5 of FIG. 2.

As indicated in FIGS. 2 and 5, the transverse mounting beam 16 is an I-beam extending horizontally and parallel to the backside 22 of the main bulldozer blade 12. The mounting brackets 18 are welded to the opposite ends of the transverse mounting bar 16. Close to the mounting bracket 18, and on the top of the upper flange of the mounting beam 16 at either end thereof a loop shaped swivel bracket 40 is welded. The swivel bracket 40 defines an open sided enclosure within which the end 42 of a piston of a hydraulic or pneumatic cylinder 44 terminates, as illustrated in FIG. 2. The end 42 is attached at a swivel connection by means of a vertical pin 46 that passes downwardly through the bracket 40 and is secured to the upper flange of the transverse mounting beam 16. The piston rod 34 of the cylinder 44 can be extended or retracted to vary the angular orientation of the main bulldozer blade 12 relative to the direction of travel of the vehicle 10.

Figure 3:
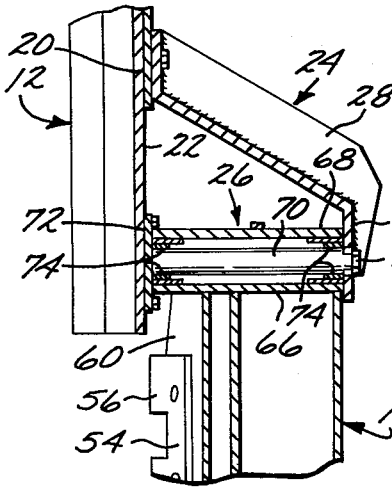
FIG. 3 is a sectional plan view taken along the lines 3—3 of FIG. 2.

The gusset plate 20 is a rectangular steel plate approximately 1 inch in thickness and is welded about its perimeter to the backside 22 of the bulldozer blade 12. The base of the generally triangular shaped mounting bracket 18 is welded to the exposed side of the gusset plate 20. The forward end of the slopeboard support channel 24 terminates in vertically oriented upwardly and downwardly extending lips 48 which are firmly bolted through the gusset plate 20 to the main bulldozer blade 12. The slopeboard support 24 extends outwardly and rearwardly from its attachment to the gusset plate 20 and terminates in an outwardly directed flange 50, as depicted in FIGS. 2 and 3. The upper leg 27 of the channel support 24 narrows in its dimensions, but follows the outwardly directed flange 50 at the rearward extremity of the channel support 24. The lower leg 28 of the channel 24 follows the contour of the flange 50, as depicted in FIG. 3. By means of its attachment to the mounting connection 26, the slopeboard support channel 24 forms a solid, rigid mounting base for the slopeboard 14 and allows very little flexing of the mounting connection 26 relative to either the main bulldozer blade 12, or to the frame of the vehicle 10.

Figure 4:
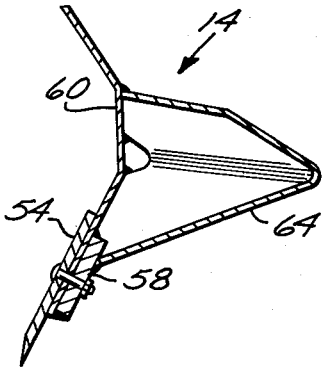
FIG. 4 is a sectional elevational view taken along the lines 4—4 of FIG. 2.

The slopeboard 14 is depicted in detail in FIGS. 2, 3 and 4. The slopeboard blade 54 has a series of laterally disposed square teeth 56 which extend downwardly and forwardly relative to a vertical orientation. The teeth 56 are defined in the slopeboard blade 54 which is bolted at periodic intervals to the slopeboard face 60. The slopeboard face 60 is sandwiched between the plow 54 and a longitudinally extending reinforcement bar 58, as depicted in FIG. 4. The slopeboard face 60 is a configured, generally trough shaped panel reinforced from the rear by a generally triangular shaped channel 64 that narrows near the centilevered end of the slopeboard 14.

At the mounting connection 26 depicted in FIGS. 3 and 5, the slopeboard 14 includes a tubular steel sleeve 66, 4 inches in diameter, oriented perpendicular to the disposition of the slopeboard 14 and welded thereto. The tubular sleeve 66 concentrically surrounds a fore and aft axle rod 70 extends from the bulldozer blade 12. The axle rod 70 is a cylindrical steel shaft 2 inches in diameter with the outboard extremity threaded at a diameter of 1½ inches. The axle rod 70 extends perpendicularly rearward from another gusset 72, which forms a vertically disposed flat slopeboard reinforcing anchor welded to the backside 22 of the main bulldozer blade 12. The axle rod 70 is welded at its base to the gusset plate 72. A pair of annular, steel bushings 68 are welded to the interior of the tubular sleeve 66 at both of its ends. Interiorally of the bushings 68 there are concentric floating bushings 74 through which the axle rod 70 is directed. The thicknesses of the floating bushings 74, the welded bushings 68 and the tubular sleeve 66 are all arranged concentrically for rotation about the axle rod 70. A self locking threaded nut 73 is secured on the threaded extremity of the axle rod 70 and holds it in position against large forces which come to bear. As can be seen, with reference to FIGS. 2, 3 and 5, the slopeboard 14 can be rotated about the axle rod 70 in a generally vertical plane from a transversely extending orientation, such as that depicted in solid lines in FIG. 2, through intermediate angles of inclination to a completely vertical upright position, as depicted in dashed lines at 38 in FIG. 2. Movement of the slopeboard 14 is always parallel to the disposition of the bulldozer blade 12.

The inclination of the slopeboard 14 is determined by the actuated condition within the actuating cylinder 32. At the base of the cylinder 32, a pair of ears 76 pass on either side of the hinge bracket 30 and are rotatably coupled thereto by a fore and aft coupling pin 78, generally aligned parallel to the fore and aft disposition of the vehicle 10. The piston rod 34 at the opposite of the cylinder 32 is fastened through a pivotal coupling 80 to a mounting connection 82 which may be adjustably locked into position relative to a track 84 defined in the slopeboard 14. It is important for the axle rod 70 and the coupling pin 78 to be parallel to each other so the slopeboard 14 may be rotated freely. While these axes are normally oriented in a fore and aft direction, it is to be understood that the axis of rotation of the slopeboard 14 can be varied relative to the direction of travel of the vehicle 10 by an uneven actuation of the fluid actuating cylinders 44 which determine the orientation of the main bulldozer blade 12.

It should also be noted from FIG. 5, that a sufficient transverse separation exists between the mounting connection 26 and the hinge 30 to allow the actuating cylinder 32 sufficient leverage to bring the slopeboard blade 14 to the upright vertical position 38 of FIG. 2. Also with reference to FIG. 5, it should be noted that the reinforcing gusset plates 20 and 72 are separated a sufficient distance on the backside 22 of the bulldozer blade 12 to define a rigid triangle of structural members. That is, the axle rod 70 extends fore and aft and is secured at its forward end to the gusset plate 20 and at its rearward extremity to the flange 50. The slopeboard support 24 extends forwardly and inwardly from the flange 50 to a secure junction with the reinforcing gusset plate 20. The structure of the main bulldozer blade 12, reinforced with the gusset plates 20 and 72, completes the triangular configuration. The rigid structure formed enhances the rigidity of the slopeboard 14 relative to the frame of the vehicle 10 by limiting severely the amount of flexure that is able to occur between the slopeboard blade 14 and the main bulldozer blade 12.

While but a single embodiment of the slopeboard mounting of the invention has been depicted, it should be understood that numerous variations and modifications will undoubtedly become readily apparent to those familiar with earth moving equipment. Accordingly, the scope of the invention should not be limited to the specific implementation proposed and depicted, but rather is defined in the claims appended hereto.

I claim:

1. In an earth moving vehicle having a main bulldozer blade carried by a vehicle frame, the improvement comprising:

a slopeboard disposed in cantilevered fashion to one side of said main bulldozer blade and constructed with a forwardly opening trough shaped panel reinforced from the rear by a generally triangular channel that narrows near a cantilevered end thereof, a transverse mounting beam secured across the front of said vehicle frame and attached to the back side of said main bulldozer blade at transversely separated rigid connections, a reinforcing gusset plate fastened to the back side of said main bulldozer blade at at least one of said mounting beam connections, a slopeboard support connected to and extending rearwardly and outwardly from said gusset plate relative to said vehicle frame, a horizontal mounting connection which includes a reinforcing anchor fastened to the back side of said main bulldozer blade outwardly from said reinforcing gusset plate, relative to said vehicle frame, an axle rod rigidly secured to said anchor and extending rearwardly therefrom and rigidly secured to a rearward and outward extremity of said slopeboard support, a sleeve secured to said slopeboard and disposed about said axle rod, and bushings interposed between said sleeve and said axle rod at opposite ends thereof, an actuating hinge connection located on said slopeboard support and inwardly relative to said vehicle frame from said horizontal mounting connection and parallel thereto, and a pressurized fluid actuating cylinder rotatably connected both to said actuating hinge connection and to said slopeboard at an attachment remote from said actuating hinge connection, whereby said slopeboard is rotatably connected to said horizontal mounting connection to thereby rotate thereabout to a selected disposition relative to said main bulldozer blade.

2. The earth moving vehicle of claim 1 further characterized in that said horizontal mounting connection and said actuating hinge connection are laterally separated by a distance which allows said actuating cylinder to rotate upwardly about said hinge connection to an inclined disposition to selectively bring said slopeboard to an orientation in which said attachment is located vertically above said horizontal mounting connection.

3. An earth moving vehicle according to claim 1 further characterized in that said reinforcing anchor is a flat reinforcing plate secured to the backside of said main bulldozer blade.

4. An earth moving vehicle according to claim 1 further characterized in that said axle rod is welded to said reinforcing anchor, said reinforcing anchor is bolted to said main bulldozer blade, and said slopeboard support is bolted to said reinforcing gusset plate.

5. An earth moving vehicle according to claim 1 further characterized in that concentric inner and outer pairs of said bushings are provided, and sid concentric outer bushings are welded to the inner surface of the ends of said sleeve and said concentric inner bushings are floating bushings in longitudinal alignment with said outer bushings.

6. The earth moving vehicle of claim 1 further characterized in that said axle rod is mounted to extend perpendicular to the orientation of said main bulldozer blade.

7. The earth moving vehicle of claim 3 further characterized in that said flat reinforcing plate and said reinforcing gusset plate are transversely separated on the backside of said bulldozer blade.

8. The earth moving vehicle of claim 1 further characterized in that said slopeboard support includes an elongated rearwardly and outwardly directed steel channel with inwardly directed legs.

9. The earth moving vehicle of claim 8 further characterized in that said channel has a mounting bracket thereatop for said actuating hinge connection and a horizontally extending outwardly directed flange for securement to a rearward extremity of said axle rod.

* * * * *